US006695033B1

(12) United States Patent
Simon

(10) Patent No.: US 6,695,033 B1
(45) Date of Patent: Feb. 24, 2004

(54) GUIDE DEVICE FOR WINDING SHAFT OF A MATERIAL HANDLING DOOR COMPRISING A FLEXIBLE CURTAIN

(76) Inventor: Bernard Simon, 20 Avenue J-B Gaillard, Caluire et Cuire (FR), 69300

( * ) Notice: Subject to any disclaimer, the term of this patent is extended or adjusted under 35 U.S.C. 154(b) by 0 days.

(21) Appl. No.: 10/088,597

(22) PCT Filed: Sep. 21, 2000

(86) PCT No.: PCT/FR00/02615

§ 371 (c)(1),
(2), (4) Date: Mar. 21, 2002

(87) PCT Pub. No.: WO01/21925

PCT Pub. Date: Mar. 29, 2001

(30) Foreign Application Priority Data

Sep. 21, 1999 (FR) ..... 99 11912

(51) Int. Cl.[7] ..... A47G 5/02

(52) U.S. Cl. ..... 160/238; 160/133; 160/235; 49/200

(58) Field of Search ..... 160/133, 191, 160/197, 198, 201, 209, 235, 238; 49/200

(56) References Cited

U.S. PATENT DOCUMENTS 3,734,161 A * 5/1973 Pierce ..... 160/133
4,757,852 A * 7/1988 Jentof et al. ..... 160/23.1
4,928,543 A * 5/1990 Johannesen et al. ..... 475/196
5,906,347 A 5/1999 Noland
6,152,207 A * 11/2000 Varley ..... 160/264
6,155,327 A * 12/2000 Wells et al. ..... 160/310
6,189,266 B1 * 2/2001 Mihalcheon ..... 49/322
6,309,199 B1 * 10/2001 Devine ..... 418/104
6,327,744 B1 * 12/2001 Dorma ..... 16/197
6,422,965 B1 * 7/2002 Balli et al. ..... 475/149
2002/0148571 A1 * 10/2002 Langenbach ..... 160/270
2002/0157797 A1 * 10/2002 Mullet ..... 160/201

FOREIGN PATENT DOCUMENTS

EP 1233140 * 8/2002 ..... 160/238 X
FR 2 694 371 2/1994

* cited by examiner

*Primary Examiner*—Bruce A. Lev
(74) *Attorney, Agent, or Firm*—Young & Thompson

(57) ABSTRACT

A guide device for winding shaft (4) of a material handling door (1) includes vertical members (2, 3) including in their upper part a bore (11) traversed by the actuator (13) of the shaft (4) such that each bearing (14, 15) cop-operates with a plate (16) fixed on the profile of the vertical members to guide the shaft (4) in rotation, while the bore (11) includes a device for braking the actuator (13) when a bearing (14, 15) and/or the corresponding plate (16) is broken thereby preventing the shaft (4) from falling vertically and for lowering the flexible curtain.

16 Claims, 3 Drawing Sheets

GUIDE DEVICE FOR WINDING SHAFT OF A MATERIAL HANDLING DOOR COMPRISING A FLEXIBLE CURTAIN

BACKGROUND OF THE INVENTION

The present invention relates to a device for guiding the winding drum of a handling door for an industrial building comprising a flexible curtain, horizontal stiffening cross-pieces and guiding slideways which are secured to the vertical and opposed uprights of the door.

The drum of a handling door makes it possible, on the one hand, for the flexible curtain to be driven so as to move it quickly between a closed position and an open position and, on the other hand, for the flexible curtain and the hauling straps to be wound around its horizontal shaft.

Guide devices which consist in axially holding the output shafts provided at each end of the drum in bearings secured to the vertical and opposed uprights of the handling door are known.

This kind of guide device has certain disadvantages as regards the vertical retention of the drum if a guide bearing breaks.

What is found when a guide bearing deteriorates is that the drum can drop down inside vertical and opposed uprights and damage the flexible curtain.

Furthermore, the vertical drop of the drum may cause the flexible curtain to be unwound quickly and may give rise to serious accidents if people are passing through the handling door at the same time.

Retaining devices which make it possible to overcome the above drawbacks to prevent the vertical drop of the drum in the event of the breakage of a bearing are known from French patent 2 694 371.

These retaining devices consist in fixing, inside the vertical and opposed uprights of the handling door, and just below the drum, a safety piece in the shape of a U the most open part of which faces toward the drum.

This safety piece makes it possible, on the one hand, to catch the drum when a bearing breaks and, on the other hand, because of the reliefs provided in the bottom of the U, to slow or impede the unwinding of the flexible curtain to prevent any risk of an accident.

The guide device according to the present invention is intended at improving the means of holding and fitting the drum between the vertical and opposed uprights of a flexible-curtain handling door.

SUMMARY OF THE INVENTION

The guide device according to the present invention consists in the fact that each vertical upright of the handling door for an industrial building comprises, at its upper part, a hole through which the cylinder of the drum passes so that the bearings of the cylinder collaborate with a respective mounting plate fixed to the profile of the uprights for guiding the rotation of said drum, while the hole comprises means of braking the cylinder when a bearing and/or the corresponding mounting plate break(s) so as to prevent, on the one hand, the drum from falling down vertically, and, on the other hand, the flexible curtain from being lowered.

The guide device according to the present invention consists in the fact that each upright is made of a section piece of rigid material in the shape of a C or a U consisting of a vertical wall which is extended at right angles by two parallel flanges each having a respective lip which delimits, facing the wall, the entry to an opening.

The guide device according to the present invention consists in the fact that the walls of each upright are pierced in their upper part with a hole of circular or oval shape for the passage of the cylinder of the drum.

The guide device according to the present invention consists in the fact that the hole comprises, on its internal periphery, a series of teeth forming means of braking the cylinder of the drum.

The guide device according to the present invention consists in the fact that the hole accommodates, on its toothed internal edge, a seal protecting the edges of the flexible curtain as the latter is wound up- around the cylinder of the drum.

The guide device according to the present invention consists in the fact that each bearing of the cylinder collaborates with a connecting mounting plate which is fixed, by screws, to the lips of the flanges of each upright.

The guide device according to the present invention consists in the fact that the hole has an oval profile, the deformed part of which is in the bottom part of the hole so as to have a diameter smaller than the outside diameter of the cylinder of the drum to allow it to be prevented from rotating when a bearing and/or the mounting plate break(s).

The guide device according to the present invention consists in the fact that the opening provided over the entire height of each upright has a width which is greater than the outside diameter of the cylinder of the drum so that the latter can be extracted laterally and by sliding once the mounting plates have been removed.

BRIEF DESCRIPTION OF THE DRAWINGS

The description which will follow with reference to the appended drawings, given by way of nonlimiting examples, will allow a better understanding of the invention, of the features it has and of the advantages it is likely to afford.

DETAILED DESCRIPTION OF THE PREFERRED EMBODIMENTS

Figure 1:
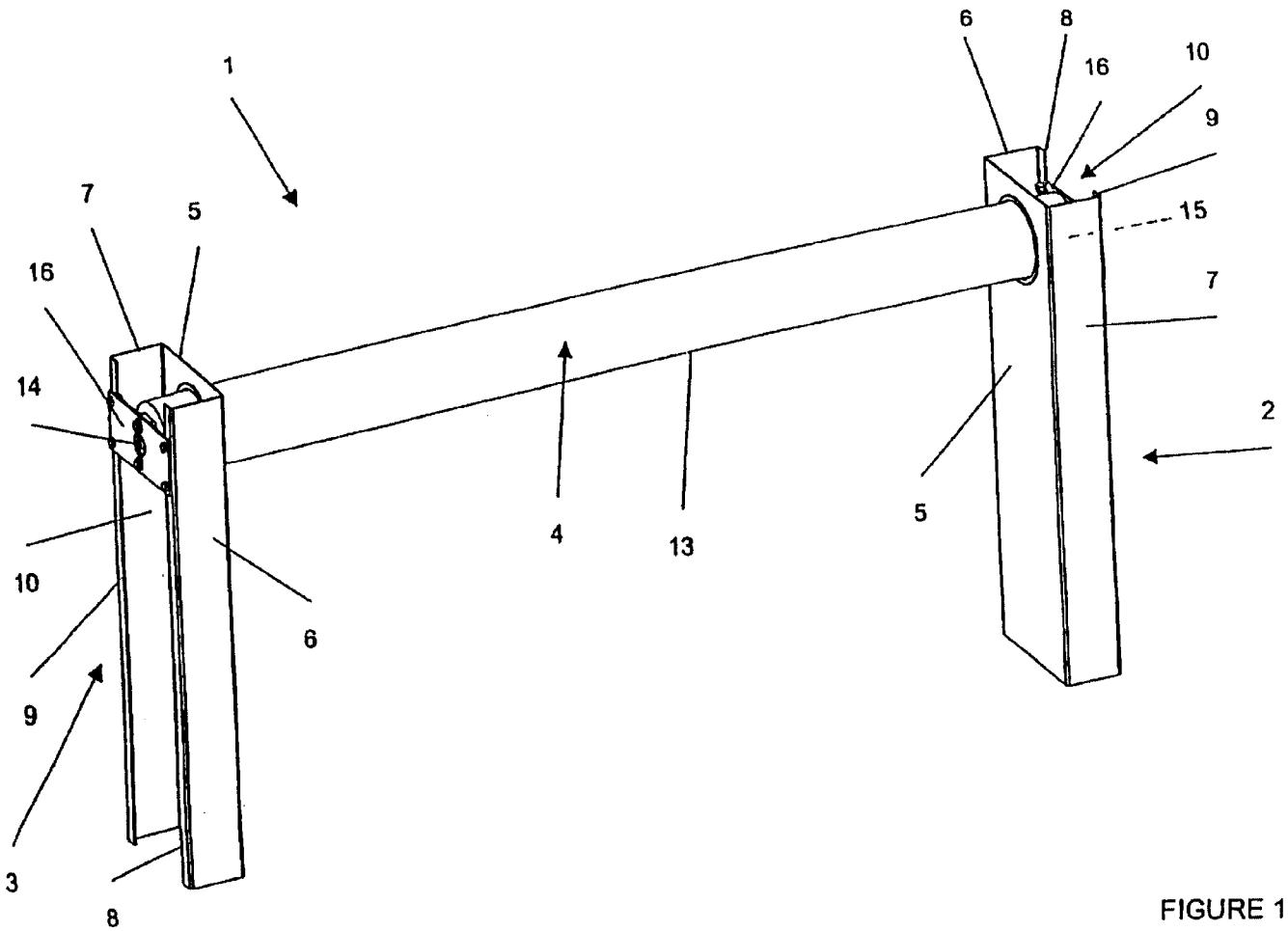
FIG. 1 is a perspective view illustrating the device for guiding the winding drum for a handling door according to the present invention.
Figure 2:
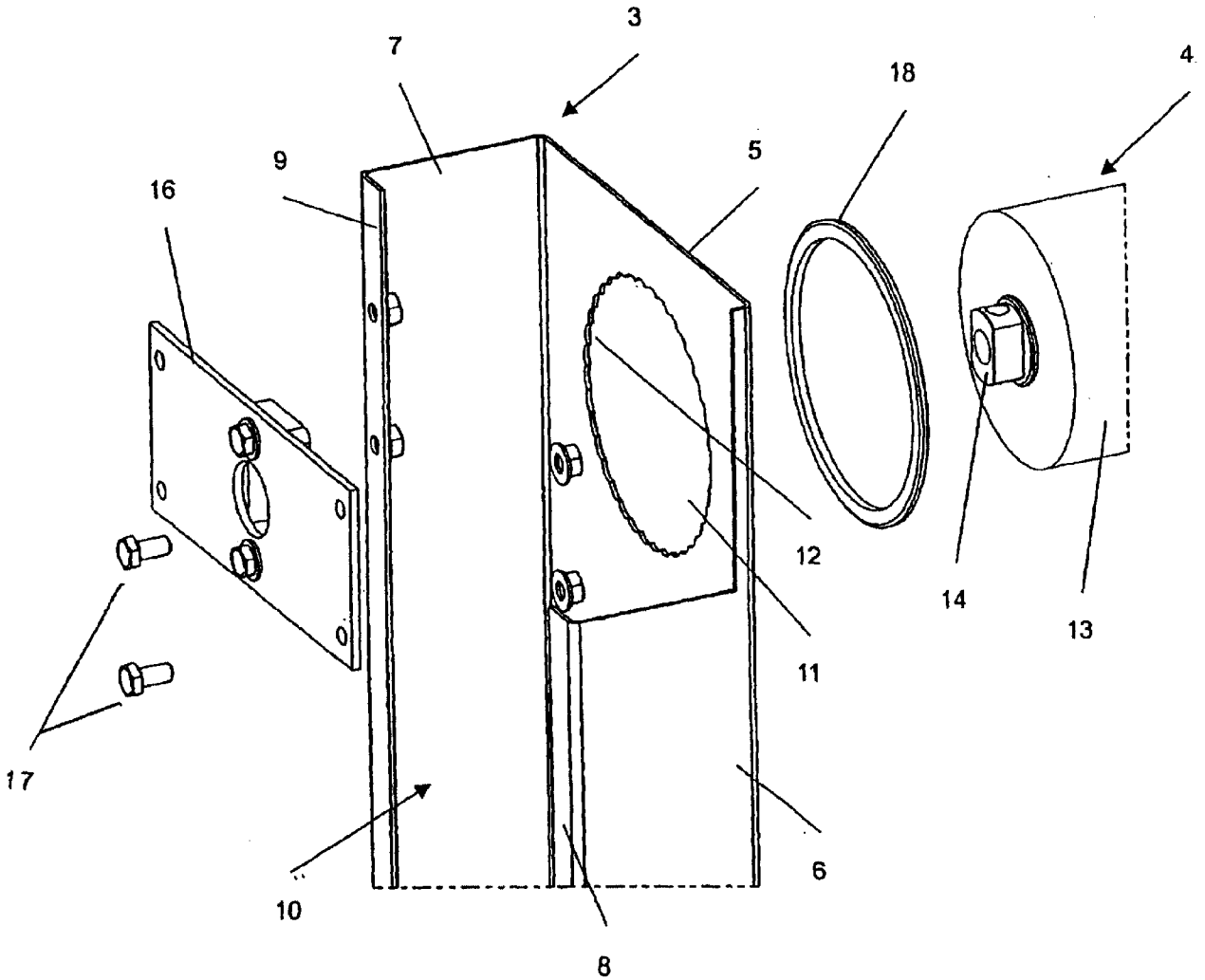
FIG. 2 is an exploded perspective view showing the drum-guiding device according to the present invention in detail.
Figure 3:
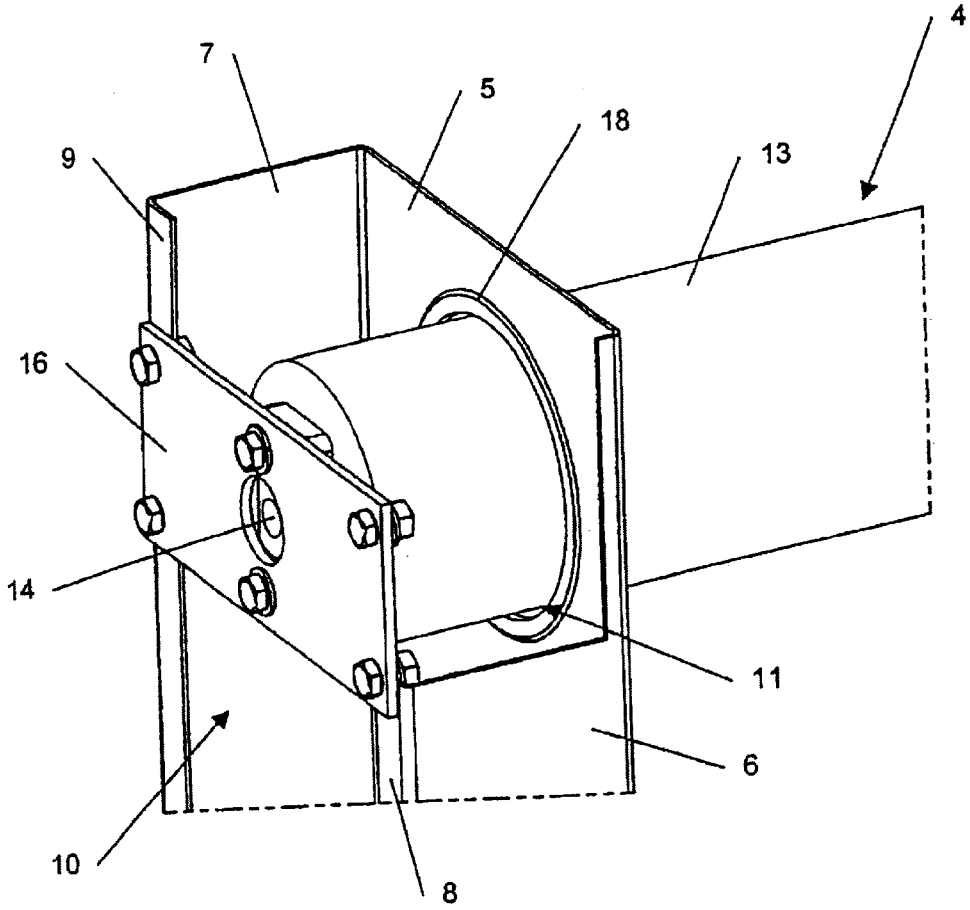
FIG. 3 is a perspective view depicting the drum-guiding device in the mounted position.

FIGS. 1 to 3 depict a handling door 1 for an industrial building comprising two vertical and opposed uprights 2 and 3 which are generally fixed against the vertical walls of an opening that is to be obstructed.

The opposed and vertical uprights 2 and 3 are joined together at the upper part of the door 1 by a winding drum 4 for vertically moving a flexible curtain known per se but not depicted.

The uprights 2 and 3 are fixed respectively, in close proximity to the opening that is to be closed by the flexible curtain, so that the flanges 6 and 7 rest against the wall and so that the walls 5 face one another.

Fixing the uprights 2 and 3 to the wall using the flanges 6 and 7 allows the technicians to be able to access the inside of these uprights via the opening 10 there is between said flanges.

The walls 5 of each upright 2 and 3 are pierced in their upper part with a hole 11 of circular or oval shape.

When the hole 11 is of circular profile, a series of teeth 12 is provided on its internal periphery to constitute a toothed internal edge.

The hole 11 has an inside diameter which is slightly greater than the outside diameter of the cylinder 13 of the drum 4. What happens is that the cylinder 13 of the drum 4 passes through the holes 11 of each upright 2 and 3 so that the ends of said cylinder are near the lips 8 and 9 of the flanges 6 and 7.

The drum 4 comprises a cylinder 13 around which the flexible curtain is rolled and at each end of the cylinder comprises bearings 14 and 15 which are connected to a drive device housed inside the cylinder 13 to allow the drum 4 to be rotated about its horizontal axis.

The cylinder 13 of the drum 4 can pivot about its horizontal axis when the bearings 14 and 15 are retained in terms of rotation on the uprights 2 and 3. For that, each bearing 14, 15 collaborates with a connecting mounting plate 16 which is fixed, by screws 17, to the lips. 8 and 9 of the flanges 6 and 7 of each upright 2 and 3.

The hole 11 houses, on its toothed internal edge, a seal 18 protecting the edges of the flexible curtain when the latter is being wound up around the cylinder 13 of the drum 4.

It may be observed that the distance between the walls 5 of each upright 2 and 3 is similar to that of the flexible curtain. This is because the walls 5 are intended to accommodate guiding slideways for guiding the flexible curtain in its vertical movements.

It may also be observed that the length of the cylinder 13 of the drum 4 is greater than the distance between the uprights 2 and 3 so that the bearings 14 and 15 are held on the lips 8 and 9 by the connecting mounting plates 16.

In operation, it is necessary that there be a clearance between the inside diameter of the seal 18 and the outside diameter of the cylinder 13 so as to allow the latter to be able to rotate about its horizontal axis of rotation.

Should a bearing 14 or 15 or a mounting plate 16 break while the handling door 1 is in operation, the cylinder 13 of the drum 4 comes immediately into contact with the teeth 12 of the hole 11 making it possible, on the one hand, to prevent the drum 4 from dropping vertically and, on the other hand, to brake the lowering of the flexible curtain.

The braking of the lowering of the flexible curtain arises out of the friction created between the teeth 12 of the hole 11 and the weight of the metal cylinder 11 of the drum.

Under the weight of the drum 4, the protective seal 18 is crushed and deformed so that the teeth 12 of the hole 11 come into contact with the cylinder 13.

When the hole 11 has an oval profile, the deformed teardrop-shaped part needs to lie in the bottom part of the hole so as to have a diameter smaller than the outside diameter of the cylinder 13 of the drum 4 to allow it to be blocked in terms of rotation when the bearings 14 and 15 or the mounting plate 16 break(s).

It may be observed that the profile of the uprights 2 and 3, and the fact that the cylinder 13 of the drum 4 passes through these via the holes 11, makes it possible to:

arrange a speed regulator which is mounted on the part of the cylinder 13 that is located in the upright, wind directly onto that part of the cylinder 13 that lies inside the upright, and without the addition of a pulley of a strap that raises a counterweight which is also housed inside the upright, arrange an electromagnetic end-of-travel device which is driven directly by the part of the cylinder 13 that lies inside the upright, without the addition of a chain-and-pulley transmission.

It may be noted that the opening 10 made over the entire height of each upright 2 and 3 has a width that exceeds the outside diameter of the cylinder 13 of the drum 4 so that the latter can be extracted laterally and by sliding once the mounting plates 16 have been removed and without having to remove the uprights.

It must also be understood that the foregoing description was given merely by way of example and that it does not in any way restrict the scope of the invention which would not be exceeded if the embodiment details described were replaced by any other equivalent.

What is claimed is:

1. A combination of a device for guiding a winding drum of a handling door for an industrial building and the winding drum, comprising:

vertical and opposed uprights secured to slideways for guiding a flexible curtain provided with horizontal stiffening crosspieces which are wound up about a cylinder of said drum and each end of which has a support bearing, wherein each vertical upright comprises, at its upper part, a hole through which the cylinder of the drum passes so that each bearing collaborates with a mounting plate fixed to a profile of the uprights for guiding the rotation of said drum, while the hole comprises means for braking the cylinder when at least one of a bearing and the corresponding mounting plate breaks so as to prevent, on the one hand, the drum from falling down vertically, and, on the other hand, the flexible curtain from being lowered.

2. The combination as claimed in claim 1, wherein each upright is made of a section piece of rigid material in the shape of one of a C and a U consisting of a vertical wall which is extended at right angles by two parallel flanges each having a respective lip which delimits, facing the wall, the entry to an opening.

3. The combination as claimed in claim 2, wherein walls of each upright are pierced in their upper part with said hole of one of circular and oval shape for the passage of the cylinder of the drum.

4. The combination as claimed in claim 3, wherein the hole has an oval profile, the deformed part of which is in the bottom part of the hole so as to have a diameter smaller than the outside diameter of the cylinder of the drum to allow it to be prevented from rotating when one of a bearing and the mounting plate breaks.

5. The combination as claimed in claim 2, wherein the opening provided over the entire height of each upright has a width which is greater than the outside diameter of the cylinder of the drum so that the latter can be extracted laterally and by sliding once the mounting plates have been removed.

6. The combination as claimed in claim 1, wherein the hole comprises, on its internal periphery, a series of teeth forming said means for braking the cylinder of the drum.

7. The combination as claimed in claim 6, wherein the hole accommodates, on its toothed internal edge, a seal protecting the edges of the flexible curtain as the latter is wound up around the cylinder of the drum.

8. The combination as claimed in claim 1, wherein each bearing of the cylinder collaborates with said corresponding connecting mounting plate which is fixed, by screws, to the lips of the flanges of each upright.

9. A handling door for an industrial building, comprising:

vertical and opposed uprights, a winding drum the cylinder of which is provided at each end with a support bearing, a flexible curtain and guiding slideways secured to said uprights, wherein each vertical upright comprises, at its upper part, a hole through which the cylinder of the drum passes so that each bearing collaborates with a mounting plate fixed to a profile of the uprights for guiding the rotation of said drum, while the hole comprises means for braking the cylinder when at least one of a bearing and the corresponding mounting plate breaks so as to prevent, on the one hand, the drum from falling down vertically, and, on the other hand, the flexible curtain from being lowered.

10. The handling door as claimed in claim 9, wherein each upright is made of a section piece of steel in the shape of one of a C and a U consisting of a vertical wall which is extended at right angles by two parallel flanges each having a respective lip which delimits, facing the wall, the entry to an opening.

11. The handling door as claimed in claim 10, wherein the walls of each upright are pierced in their upper part with said hole of one of circular and oval shape for the passage of the cylinder of the drum.

12. The handling door as claimed in claim 11, wherein the hole has an oval profile, the deformed part of which is in the bottom part of the hole so as to have a diameter smaller than the outside diameter of the cylinder of the drum to allow it to be prevented from rotating when one of a bearing and the mounting plate breaks.

13. The handling door as claimed in claim 10, characterized in that the opening (10) provided over the entire height of each upright (2, 3) has a width which is greater than the outside diameter of the cylinder (13) of the drum (4) so that the latter can be extracted laterally and by sliding once the mounting plates (16) have been removed.

14. The handling door as claimed in claim 9 wherein the hole comprises, on its internal periphery, a series of teeth forming said means for braking the cylinder of the drum.

15. The handling door as claimed in claim 14, characterized in that the hole (11) accommodates, on its toothed internal edge (12), a seal (18) protecting the edges of the flexible curtain as the latter is wound up around the cylinder (13) of the drum (4).

16. The handling door as claimed in claim 9, wherein each bearing of the cylinder collaborates with said corresponding connecting mounting plate which is fixed, by screws, to the lips of the flanges of each upright.

* * * * *